United States Patent [19]

Round

[11] 3,957,001

[45] May 18, 1976

[54] FURNACE IMPLOSION DOOR

[75] Inventor: Byron Joseph Round, Simsbury, Conn.

[73] Assignee: Combustion Engineering, Inc., Windsor, Conn.

[22] Filed: Dec. 23, 1974

[21] Appl. No.: 535,742

[52] U.S. Cl. ..... 110/173 B; 236/45; 137/526

[51] Int. Cl.[2] ..... F23M 7/00; F23N 5/24

[58] Field of Search ..... 122/478, 504; 110/173 B; 236/45; 137/526

[56] References Cited

UNITED STATES PATENTS

| | | | |
|---|---|---|---|
| 2,160,262 | 5/1939 | Engels | 110/173 |
| 2,989,039 | 6/1961 | Frendberg et al. | 122/478 |
| 3,071,448 | 1/1963 | Hochmuth | 122/478 |
| 3,297,251 | 1/1967 | Pfister | 236/45 |
| 3,782,411 | 1/1974 | Turner | 137/526 |

*Primary Examiner*—Kenneth W. Sprague

[57] ABSTRACT

Damage due to implosions occurring within the furnace chambers of balance draft vapor generators is prevented by the provision in the downstream combustion gas duct of one or more openings that are closed during normal operation by doors which are automatically released upon the occurrence of an inordinately high negative fluid pressure atmosphere in the furnace. The doors, when released, operate to obstruct the flow of combustion gas out of the furnace chamber and thereby, in association with operation of the forced draft fan, overcome the excessive negative pressure in the furnace chamber. Also, the exposure of the induced draft fan to outside air upon release of the door prevents the fan from producing an inordinate negative pressure adjacent the door that would otherwise tend to close the door and also detrimentally affect the furnace pressure.

7 Claims, 5 Drawing Figures

FURNACE IMPLOSION DOOR

BACKGROUND OF THE INVENTION

Vapor generators operating on the balanced draft principle have long been known. In such units a forced draft fan operates to impart air for combustion to the furnace chamber while an induced draft fan operates to extract the generated combustion gas from the unit for ultimate discharge from the stack. According to common practice the forced draft fan is operated in response to the demand for combustion air as dictated by the fuel firing system controls. The induced draft fan, on the other hand, is controlled to provide a slightly negative (e.g. 0.5 inches water) fluid pressure in the furnace cavity thereby preventing the possibility of leakage of combustion gases from the furnace chamber to the exterior of the unit.

As the size of vapor generators has increased, the size and operating capacities of the forced draft and induced draft fans necessary to maintain balanced furnace pressures have increased concomitantly. Due to this fact, conditions have been created within the furnace cavity of large capacity vapor generators during operational excursions that have caused excessive negative fluid pressures therein to the extent that there have resulted furnace implosions of such magnitude as to cause serious damage to the unit.

Among the suggestions made with a view toward protecting against such implosions has been to construct vapor generators of greater structural strength thereby enabling the unit to withstand greater negative pressures. Such solution obviously increases significantly the fabrication cost of a vapor generator. Another suggestion would effect the rapid closure of the induced draft fan damper to prevent the extraction of combustion gas from the furnace while simultaneously admitting air under pressure through the forced draft fan. In addition to adding significantly to the cost of the unit such solution is of questionable effectiveness due to the inability to close the dampers with sufficient speed to prevent an implosion.

It is to a more effective solution to the above desdcribed problem, therefore, that the present invention is directed.

SUMMARY OF THE INVENTION

Accordingly, there is provided in a balanced draft vapor generator, including a furnace chamber in which fuel is burned for the generation of combustion gases, means forming a passage communicating with said furnace chamber for the discharge of combustion gases therefrom, a forced draft fan operative to supply air for combustion to said furnace chamber, and an induced draft fan operative in said passage to induce flow of combustion gases therethrough, the improvement comprising means for alleviating the effects of an excessive negative fluid pressure in said furnace chamber, said means including one or more through openings in the wall of said passage-forming means communicating with an external source of air, a releasable closure door for said opening operatively attached to said passage-forming means to open inwardly into said passage, and means retaining said door normally closed and operative to release the same for opening upon the occurrence of a predetermined excessive negative fluid pressure in said furnace chamber.

A principal object of the invention, therefore, is to provide simple, yet effective means in a balanced draft vapor generator organization to prevent the harmful effects of a furnace implosion caused by the occurrence of excessive negative fluid pressures in the furnace chamber.

Another object of the invention is to provide mechanism for use in a balanced draft vapor generator organization that is effective to prevent, or at least significantly retard the expulsion of fluid pressure from the furnace chamber during the occurrence of excessive negative fluid pressures thereby to avoid the creation of an implosive condition.

Yet another object of the invention is to provide means in a balanced draft vapor generator organization that is effective to prevent continued operation of the induced draft fan from impeding operation of the mechanism.

For a better understanding of the invention, its operating advantages and the specific objectives obtained by its use, reference should be made to accompanying drawings and description which relate to a preferred embodiment thereof.

DESCRIPTION OF THE PREFERRED EMBODIMENT

Figure 1:
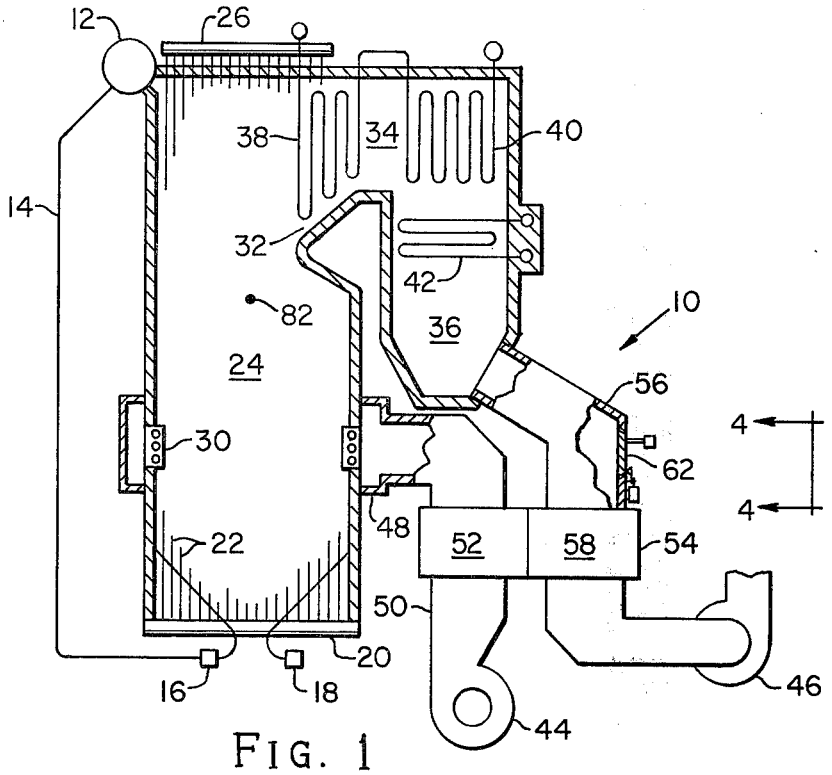
FIG. 1 is an elevational schematic representation of a balanced draft vapor generator incorporating the present invention.
Figure 4:
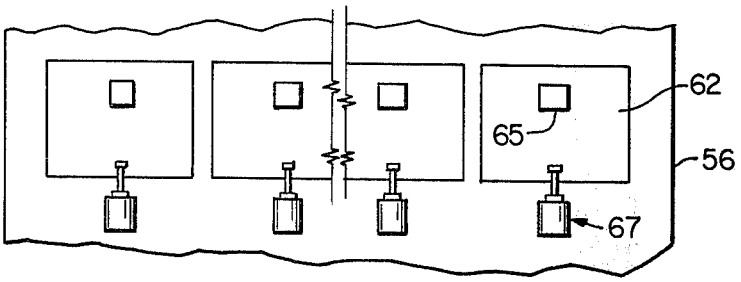
FIG. 4 is an end view taken along line 4—4 of FIG. 1.

The vapor generator organization 10 illustrated in FIG. 1 includes a vapor drum 12. This drum supplies liquid separated from the vapor-liquid mixture supplied thereto through downcomers 14 to the lower water wall headers 16, 18 and 20 to which are connected the lower ends of water cooled tubes 22 forming walls and roof of the furnace chamber 24. The upper ends of some of the aforesaid water cooled tubes 22 are connected directly to vapor drum 12. Others terminate in the upper wall header 26 which, in turn, communicate with drum 12 through connecting tubes.

Burners 30 are located in the lower portion of the furnace chamber 24. Fuel and air are discharged through these burners into the furnace chamber 24 where combustion occurs. The combustion gases generated in the furnace chamber are caused to flow upwardly towards the furnace outlet 32 while giving off a substantial portion of the heat contained therein to the tubes 22 for vapor generation purposes. In leaving the furnace chamber 24 the gases enter the horizontal and vertical gas passes 34 and 36 respectively in which vapor heating devices, such as the primary and secondary superheaters, 38 and 40 respectively, are located. Additional heat absorbing surface such as economizer 42 may be arranged in the gas pass 36 through which the gases flow on their way to a stack (not shown).

The herein described vapor generator organization is of the balanced draft type in which forced draft fan 44 in association with dampers (not shown) controls the flow of combustion air to burners 30 while induced draft fan 46 operates to regulate the extraction flow of combustion gases from the unit for ultimate discharge from the stack. The forced draft fan 44 communicates with the burner wind box 48 through a duct 50 which passes incoming air through the air side 52 of an air heater 54. The induced draft fan 46 connects with the discharge end of the gas pass 36 by means of duct 56 that extends through the gas side 58 of the air heater 54. In practice, operation of the induced draft fan is such as to maintain fluid pressure in the furnace chamber 24 at slightly below atmospheric pressure. In this way leakage of combustion gas from the unit is prevented.

Figure 2:
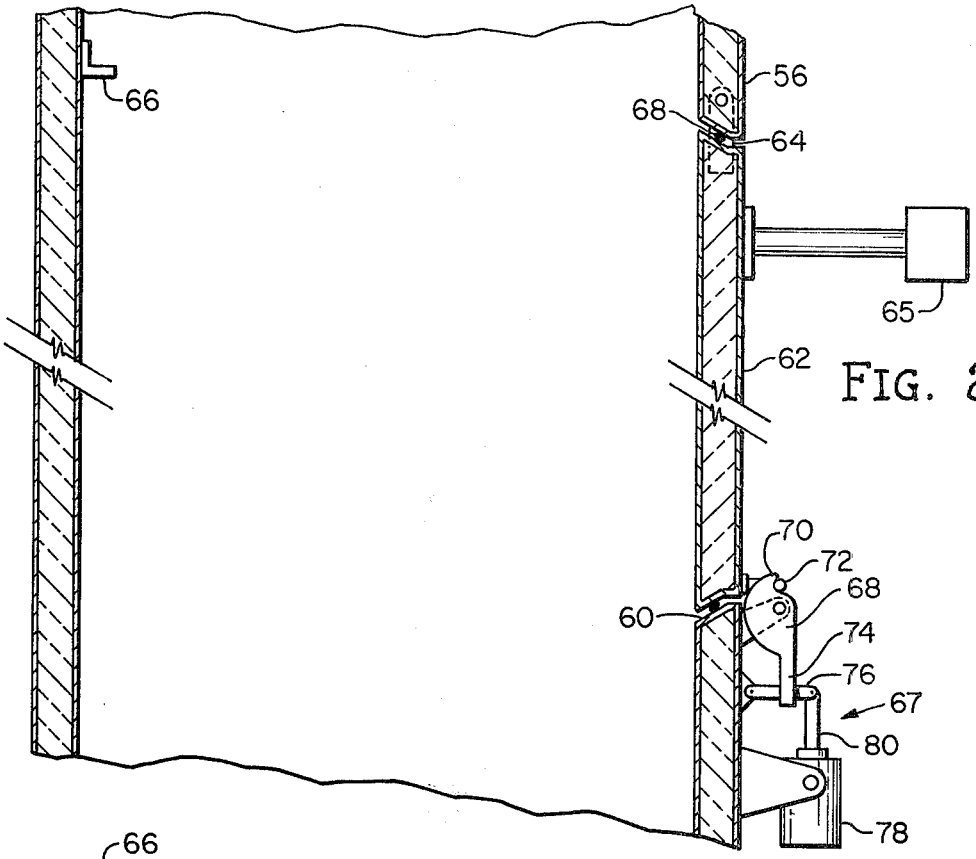
FIG. 2 is a fragmentary elevational section of the implosion door of the present invention illustrated in its closed position.
Figure 3:
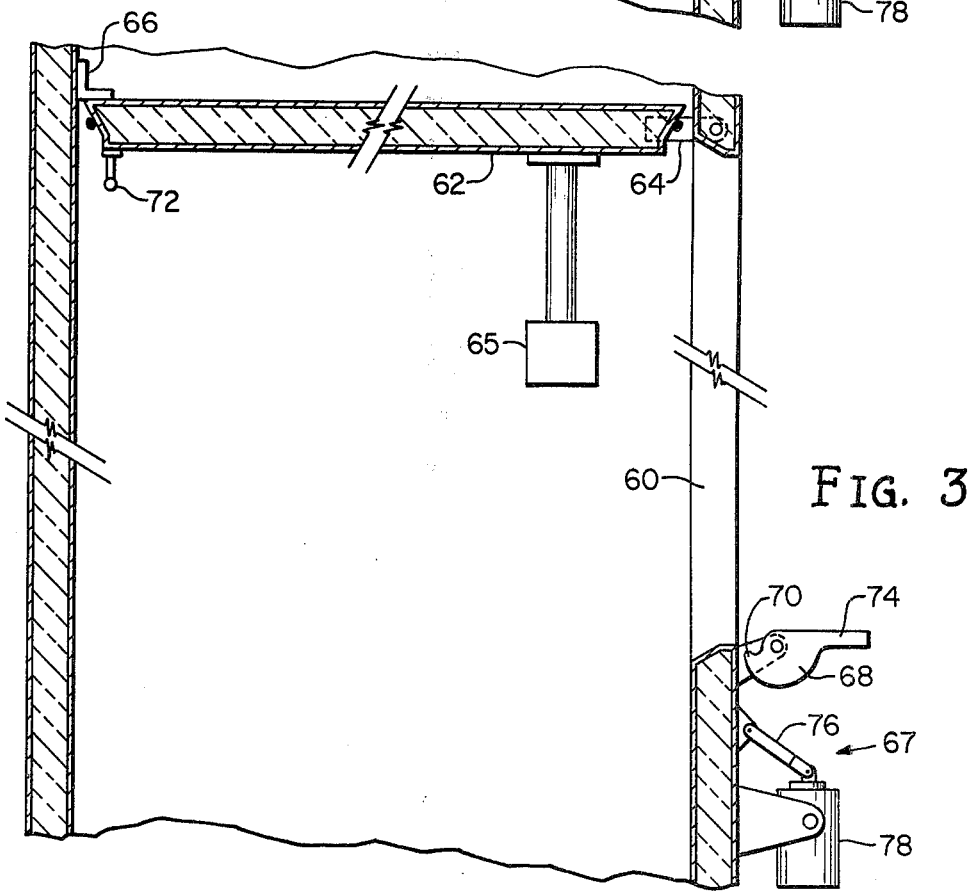
FIG. 3 is a view similar to FIG. 2 showing the implosion door of the present invention in its released position.

According to the invention the wall in a vertical run of the duct 56 is provided with one or more through openings 60 by means of which open communication is made between the interior of the combustion gas flow passage and the exterior of the unit. Each opening 60 is closed by a closure door 62 which, as shown best in FIGS. 2 and 3, is adapted for pivotal movement into the interior of the duct 56 by means of hinge construction 64. The door 62 is preferably sized to extend substantially fully transversely of the duct interior and a stop in the form of angle member 66 is provided on the duct wall opposite that containing the door to locate the door, in its released position, across the duct section. A counterweight 65 may be provided on the door to assist its movement to its released position. The door is maintained closed during normal operation of the unit by a latching mechanism, indicated generally as 67, with appropriate sealing members 68 being provided to prevent combustion gas leakage across the seam.

The latching mechanism 67 employed in the illustrated embodiment of the invention comprises a cam member 68 that is pivotally attached to the duct wall adjacent the opening 69. At one end the cam member contains a finger 70 engagable with bracket 72 on the free end of the door 62. At its other end the cam member contains a second finger 74 that is engaged by a pivotally mounted latch 76. The latch 76 is actuated by an electrically operated solenoid actuator 78 whose armature 80 connects with the latch. The solenoid actuator 78 is arranged for operation upon the occurrence of a predetermined excess negative pressure level within the furnace chamber 24 as determined by an appropriate pressure sensing device 82 (FIG. 1).

In operation, upon the determination by means of pressure sensor 82, of the occurrence of an excessive negative pressure in the furnace chamber 24, the solenoid actuator 78 is energized to actuate latching mechanism 68 for releasing the door 62. The door pivots under the influence of the counterweight 65 and the differential pressure across the door to its released position against the stop 66. In this position the door 62 provides an obstruction in the combustion flow path restricting the flow of gas from the furnace chamber 24. Simultaneously therewith, continued operation of the forced draft fan 44 serves to admit more air to the furnace chamber thereby pressurizing the latter to overcome the excessive negative pressure excursion.

By means of the exposure of the suction side of the induced draft fan to the exterior of the unit through the opening 60 upon release of the door 62, the fan is prevented from producing a high negative static pressure on the downstream side of the door which would otherwise have a tendency to return the same to its closed position.

As shown, the described embodiment of the invention utilizes a plurality of openings 60 with associated closure doors 62 laterally spaced across the wall of duct 56. Each of the respective closure doors 62 is released upon energization of its associated solenoid actuator 78, each of which actuators is set to respond to a different pressure in the furnace chamber 24. Thus, by so setting the respective solenoid actuators 78 a gradual restriction of the gas flow passage is effected.

Figure 5:
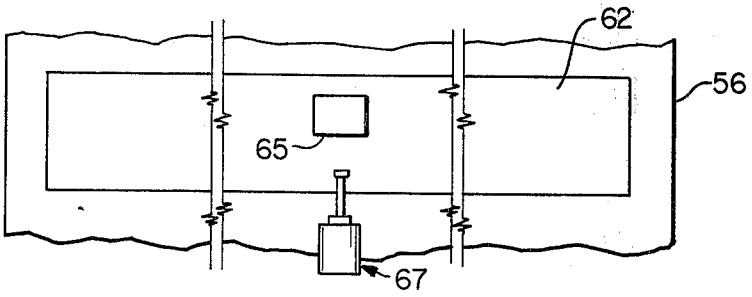
FIG. 5 is a view similar to FIG. 4 illustrating another embodiment of the invention.

Alternatively, however, all of the solenoid actuators can be set for simultaneous energization whereby the doors will be released simultaneously or, as shown in FIG. 5, the inventive concept can be implemented by only a single opening 60 having an associated closure door 62. In this arrangement the door 62 is dimensioned to substantially fully obstruct, when released, the gas passage defined by the interior of the duct.

It will be understood that various changes in the details, materials and arrangements of parts which have been herein described and illustrated in order to explain the nature of the invention, may be made by those skilled in the art within the principal and scope of the invention as expressed in the appended claims.

What is claimed is:

1. In a balanced draft vapor generator organization including a furnace chamber in which fuel is burned for the generation of combustion gases, means forming a passage communicating with said furnace chamber for the discharge of combustion gases therefrom, a forced draft fan operative to supply air for combustion to said furnace chamber, and an induced draft fan operative in said passage to induce flow of combustion gases therethrough, the improvement comprising means for alleviating the effects of an excessive negative fluid pressure in said furnace chamber, said means including:

a. a through opening in the wall of said passage-forming means communicating with an external souce of air and disposed in said organization intermediate, in the gas flow sense, said forced and induced draft fans;

b. a releasable closure door for said opening operatively attached to said passage-forming means to open inwardly into said passage, and c. means retaining said door normally closed and operative to release the same for opening upon the occurrence of a predetermined excessive negative pressure in said furnace chamber.

2. The improvement recited in claim 1 in which said closure door is sized to extend substantially fully across said passage when in said open position.

3. The improvement recited in claim 2 in which said closure door is hinged for angular movement and including means in said passage-forming means providing a stop engaging said door in its open position to locate the same in a passage blocking position.

4. The improvement recited in claim 1 including a releasable latch to retain said door in a closed position, and means for releasing said latch upon the occurrence of a predetermined excessive negative fluid pressure in said furnace chamber.

5. The improvement recited in claim 4 in which said latch releasing means is an electrically actuated solenoid, and including means for actuating said solenoid including means for sensing fluid pressure in said furnace chamber.

6. The improvement recited in claim 1 including a plurality of openings disposed in laterally spaced positions in said passage-forming means.

7. The improvement recited in claim 6 in which each of the doors closing the respective openings is releasable to an open position at a different predetermined fluid pressure than the other doors.

* * * * *